US008006981B2

(12) United States Patent
Gibson

(10) Patent No.: US 8,006,981 B2
(45) Date of Patent: Aug. 30, 2011

(54) MOVING TARGET SYSTEM FOR DEFENSIVE TRAINING

(75) Inventor: Michael H. Gibson, Boise, ID (US)

(73) Assignee: Mike Gibson Manufacturing, Inc., Caldwell, ID (US)

( * ) Notice: Subject to any disclaimer, the term of this patent is extended or adjusted under 35 U.S.C. 154(b) by 0 days.

(21) Appl. No.: 12/322,547

(22) Filed: Feb. 4, 2009

(65) Prior Publication Data

US 2011/0031695 A1 Feb. 10, 2011

(51) Int. Cl.
*F41J 9/00* (2006.01)

(52) U.S. Cl. ..... 273/359; 273/406

(58) Field of Classification Search ..... 273/359, 273/366–371, 403–410
See application file for complete search history.

(56) References Cited

U.S. PATENT DOCUMENTS

| | | | | | |
|---|---|---|---|---|---|
| 2,586,958 | A | * | 2/1952 | Keller | 273/406 |
| 2,793,038 | A | * | 5/1957 | Wallace et al. | 273/369 |
| 2,923,549 | A | * | 2/1960 | Del Mar et al. | 273/361 |
| 3,014,725 | A | * | 12/1961 | Lewis | 273/406 |
| 3,020,047 | A | * | 2/1962 | Spieth | 273/406 |
| 3,218,461 | A | * | 11/1965 | Saunders et al. | 250/202 |
| 3,559,994 | A | * | 2/1971 | Larsen | 273/406 |
| 3,602,511 | A | * | 8/1971 | Gehmann | 273/406 |
| 3,614,102 | A | * | 10/1971 | Nikoden, Sr. | 273/406 |
| 3,865,373 | A | * | 2/1975 | Knight | 273/369 |
| 3,874,670 | A | * | 4/1975 | Weihl | 273/406 |
| RE30,013 | E | * | 5/1979 | Knight | 273/369 |
| 4,340,370 | A | * | 7/1982 | Marshall et al. | 434/22 |
| 4,890,847 | A | * | 1/1990 | Cartee et al. | 273/406 |
| 5,016,890 | A | * | 5/1991 | Sato et al. | 463/52 |
| 5,350,180 | A | * | 9/1994 | Acock | 273/406 |
| 5,403,017 | A | * | 4/1995 | Doss et al. | 273/372 |
| 5,775,698 | A | * | 7/1998 | Jones et al. | 273/359 |
| 5,848,791 | A | * | 12/1998 | Beyer et al. | 273/359 |
| 5,868,396 | A | * | 2/1999 | Theissen | 273/406 |
| 5,947,477 | A | * | 9/1999 | Turnipseed | 273/407 |
| 6,629,695 | B2 | * | 10/2003 | Tisdell | 273/359 |
| 6,945,534 | B1 | * | 9/2005 | Lindsey | 273/359 |
| 2007/0235943 | A1 | * | 10/2007 | Bateman et al. | 273/403 |
| 2008/0224410 | A1 | * | 9/2008 | Bengtsson et al. | 273/359 |

* cited by examiner

*Primary Examiner* — Mark Graham

(74) *Attorney, Agent, or Firm* — Bennet K. Langlotz; Langlotz Patent & Trademark Works, Inc.

(57) ABSTRACT

A moving target system for defensive training includes an elongated ground-based track defining a track axis, a trolley operable to move along the track, the trolley having a target support facility, a driver operable to move the trolley along the track, and the target facing in a direction angularly offset from perpendicular to the track axis. The target support facility may be operable to fall from a vertical position when the trolley reaches an end of the track. There may be an actuator operably connected to the driver to initiate movement of the trolley when actuated.

17 Claims, 6 Drawing Sheets

MOVING TARGET SYSTEM FOR DEFENSIVE TRAINING

FIELD OF THE INVENTION

The present invention relates to a moving target system for defensive training. The moving target system for defensive training has particular utility in connection with providing a system for training individuals to respond to threats closing from a limited distance.

BACKGROUND OF THE INVENTION

It is generally recognized that a criminal with a knife standing at approximately 21 feet from a law enforcement officer or other individual can potentially close the distance and stab the officer before the officer can draw his firearm to defend himself. While most law enforcement agencies have tried to graphically demonstrate this fact to their officers, many officers, particularly new officers, have failed to recognize the threat as being real and quite possibly fatal.

Because of this threat, all officers need to be able to bring their firearms into action in less than 1.5 seconds, which is the approximate time it takes for an average person to run 21 feet. Because law enforcement officers are typically required to wear a holster that will prevent a criminal from stealing their guns, and because some police officers do not have adequate time to practice their gun handling skills beyond what is required by their department, too few officers have acquired the skill to draw their gun in less than 1.5 seconds.

Although prior art moving targets are known, they are limited in their motion. Some only move laterally with respect to the shooter to train a shooter to lead a moving target. Others move by flipping about a vertical axis, to reveal a practice target that must be identified as friend or foe before deciding whether to shoot. Others flip up about a horizontal axis, providing a "pop-up" target that requires the shooter to react quickly to a target at a given location. Many automatic target carriers used at indoor and other practice ranges provide a motorized target carrier that is operated solely to allow a shooter to attach a target, send it to a selected distance, shoot at the target, and retrieve the target without having to go downrange. These operate at limited speed and are not intended for shooting during operation.

Few prior art moving target systems operate with motion toward the trainee or in any way that results in them changing their distance relative to the shooter. As a result, most do not enable an officer to practice defending against an approaching assailant. Those that do provide motion toward the shooter have practical limitations and disadvantages. Such systems are typically standard "runner" moving target systems that are designed to present a target that moves laterally for the shooter. These can be used by a user standing at one end of the target run to shoot at the approaching target.

However, these are "motorized clothesline" systems that have a powered overhead cable and pulley system. This puts critical support and operation components directly in the background of the target, making damage even from well-aimed bullets likely. Efforts to make such components more bullet resistant increases cost and weight, both disadvantages. To avoid frequent damage occurrences, the shooter may stand offset from the track, but this loses the intensive training effect of having a target coming directly at the trainee. Moreover, such prior art systems require an electrical power source. Because few outdoor shooting ranges provide AC power, this is impractical, and batteries supply only limited power for limited duration.

Therefore, a need exists for a practical moving target system with nonzero perpendicular motion vector component that can be used for providing a system for training law enforcement officers to respond to targets closing from 21 feet. In this regard, the various embodiments of the present invention substantially fulfill at least some of these needs. In this respect, the moving target system for defensive training according to the present invention substantially departs from the conventional concepts and designs of the prior art, and in doing so provides an apparatus primarily developed for the purpose of providing a system for training law enforcement officers to respond to targets closing from 21 feet in 1.5 seconds.

SUMMARY OF THE INVENTION

The present invention provides an improved moving target system for defensive training, and overcomes the above-mentioned disadvantages and drawbacks of the prior art. As such, the general purpose of the present invention, which will be described subsequently in greater detail, is to provide an improved moving target system for defensive training that has all the advantages of the prior art mentioned above.

To attain this, the preferred embodiment of the present invention essentially comprises an elongated ground-based track defining a track axis, a trolley operable to move along the track, the trolley having a target support facility, a driver operable to move the trolley along the track, and the target facing in a direction angularly offset from perpendicular to the track axis. The target support facility may be operable to fall from a vertical position when the trolley reaches an end of the track. There may be an actuator operably connected to the driver to initiate movement of the trolley when actuated. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
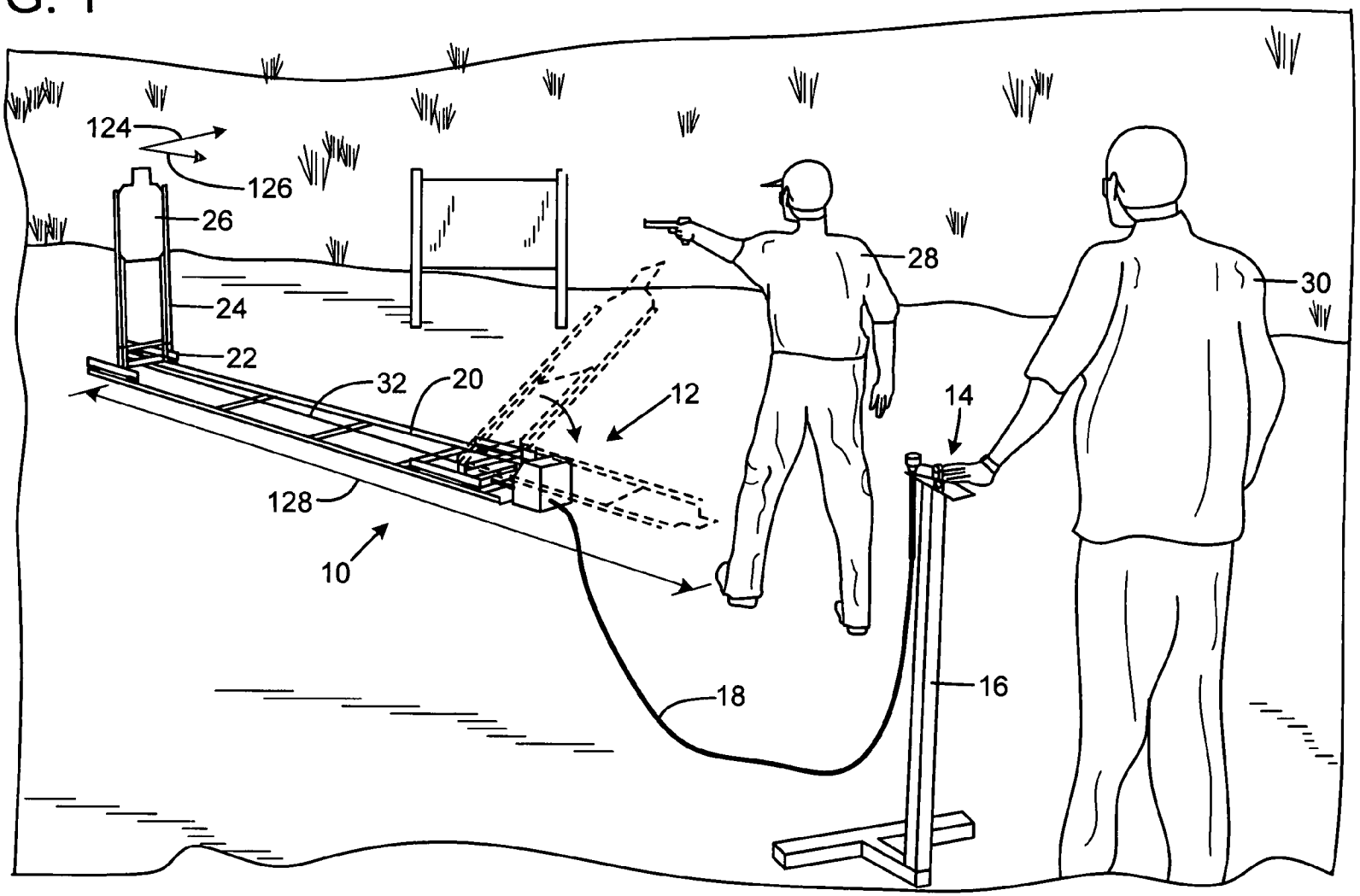
FIG. 1 is a side perspective view of the current embodiment of the moving target system for defensive training constructed in accordance with the principles of the present invention.

A preferred embodiment of the monocular with attachment points of the present invention is shown and generally designated by the reference numeral 10.

FIG. 1 illustrates the moving target system 10 of the present invention. More particularly, the system 10 is shown in use with an instructor 30 teaching a trainee shooter 28 how to defend himself with a firearm against target 26. Responsive to the instructor 30 depressing the actuator 14 mounted on pole 16, a drive mechanism 12 is activated by a power takeoff cable 64 enclosed in power takeoff cable sheath 18. The drive mechanism is located near the shooter, avoiding the risk that an errant shot could damage its valuable operating components. The drive mechanism 12 then rapidly winds up the cable 32, which pulls the trolley 22 along the track 20 from one end to the other towards the shooter 28. The shooter 28 practices drawing his firearm and shooting the target 26 until the trainee can reliably hit the target 26 before the trolley 22 reaches the end of the track 20 or meet other performance goals.

The system 10 not only teaches the shooter 28 the importance of a fast, accurate pistol draw, but also demonstrates the importance of evasive movement on the part of the shooter 28. It also provides an intense simulation of a threat, allowing the shooter to become more accustomed to the circumstances and making him less impaired by the startling effect of stress in a similar actual threat situation. These benefits are achieved by the target 26 pivoting on the trolley 22 and falling toward the shooter 28 when the trolley 26 reaches the end of the track 20. If the shooter 28 is standing too close to the end of the track 20, the target 26 will fall into him. The cardboard target 26 and light wood target supports 24 do not hit with enough force to hurt the shooter 28 or knock his gun out of his hand, but nonetheless provide an effective lesson.

Figure 2:
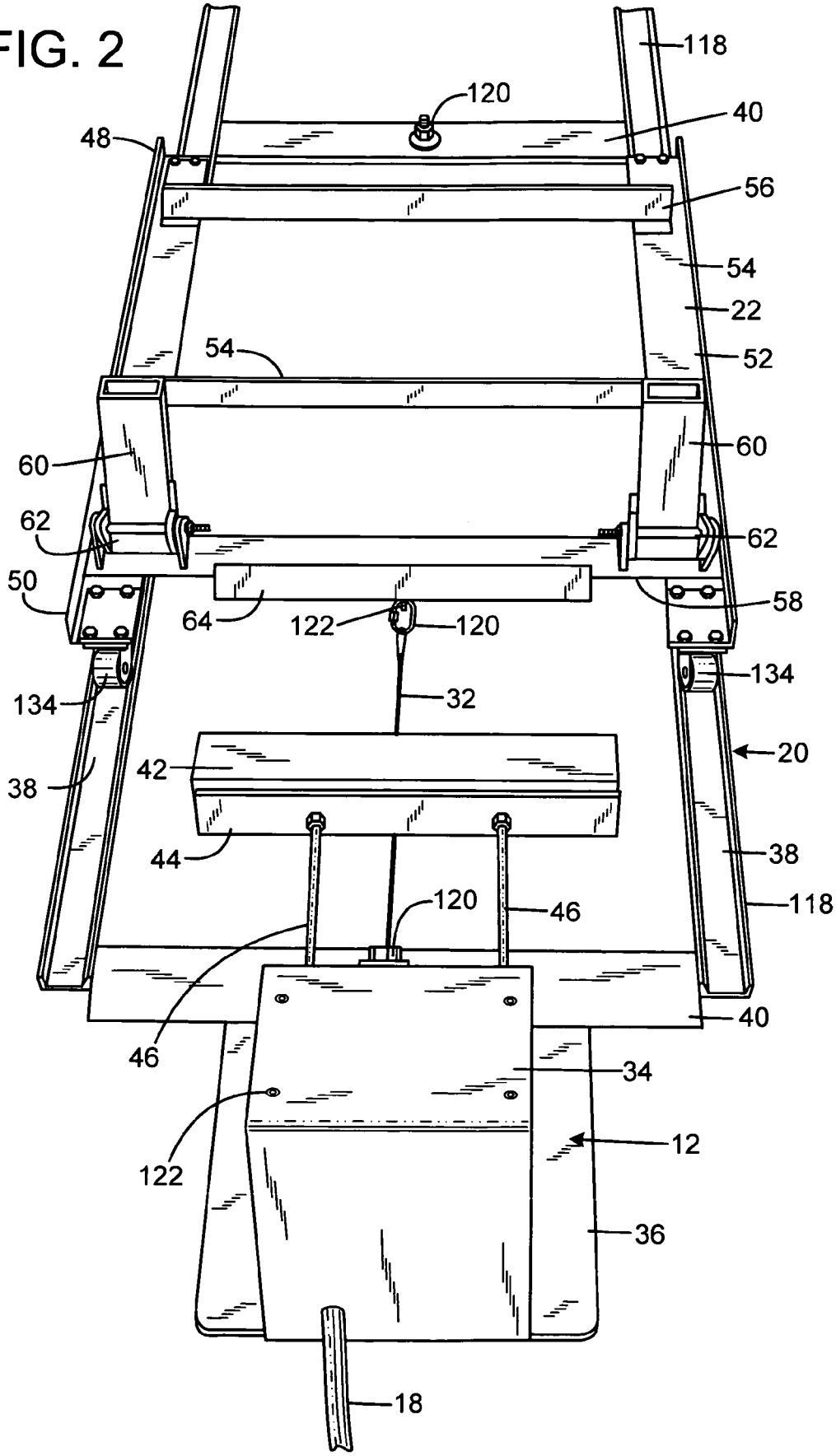
FIG. 2 is a top perspective view of the current embodiment of the drive mechanism and track of the present invention.

FIG. 2 illustrates the drive mechanism 12 and track 20 of the improved moving target system 10 of the present invention. More particularly, the drive mechanism 12 has a housing 34 releasably connected to a base plate 36 by housing bolts 122. The power takeoff cable 64 emerges from the rear of the housing 34 in its sheath 18. Two gas shocks 46 and the cable 32 protrude from the front of the housing 34. The gas shocks 46 are used to bring the trolley 22 to a stop without damage by cushioning the otherwise sudden deceleration. The gas shocks 46 are connected to a rigid shock plate 44, which has a shock pad 42 attached to it. The shock pad 42 is a dense foam in the current embodiment that prevents jarring and noisy metal-to-metal contact between the front bumper 64 of the trolley 22 and the shock plate 44.

The track 20 is modular and consists of six track segments 118 in the current embodiment. Each track segment 118 is about 4 feet long and 20 inches wide. Each track segment 118 has two rails 38 joined together by two cross members 40. The rails 38 are ½" deep×2" wide shallow U-shaped steel channels in the current embodiment. The cross members 40 of the track segments 118 are bolted together by track segment bolts 120. One end of one of the track segments 118 is bolted to the base plate 36 of the drive mechanism 12. It is important that the track segment 118 that is bolted to the base plate 36 is square with the drive mechanism 12 so that the trolley 22 impacts the gas shocks 46 evenly to avoid bending them. The track 20 should be anchored so that repeated impacts by the trolley 22 into the gas shocks 46 does not cause the track 20 to shift towards the shooter 28. This can be accomplished by driving spikes into the ground on the drive mechanism side of any of the cross members 40 or by placing a weight behind the drive mechanism 12 opposite the track 20.

The trolley 22 has two side members 54 that are joined by a front crossbeam 58 and a rear crossbeam 56. Wheels 134 attached to the underside of the side members 54 frictionally engage with the rails 38 to guide the motion of the trolley 22. The front 50 of the trolley 22 has a front bumper 64 and a vertical bracket 122. A quick link 120 releasably joins the end of the cable 32 protruding from the drive mechanism 12 to the vertical bracket 122. Two hinges 62 pivotably connect two target holders 60 to the front crossbeam 58. The hinges 62 are positioned so that they are perpendicular to the track 20 and enable the target 26 to fall forward when the trolley 22 is stopped by the gas shocks 46. An upper crossbeam 60 joins the two target holders 60. The target holders 60 are tubes that are rectangular in cross-section and are adapted to receive one end of two target supports 24. The target supports 24 hold the target 26 in a vertical position facing the shooter 28, who is positioned at one end of the track 20, while the trolley 22 is in forward motion. The target supports 24 are 1"×2" wooden sticks in the current embodiment. The target holders 60 are positioned on the front crossbeam 58 so that the target supports 24 are spaced properly to receive an 18 inch wide International Practical Shooting Confederation or International Defensive Pistol Association target; however, a target of any height and width can be used. In the current embodiment, the trolley 22 is made of aluminum, which makes it sufficiently lightweight to be pulled about 21 feet by the drive mechanism 12 in about 1.5 seconds, overcoming the wind resistance created by the target 26.

Figure 3:
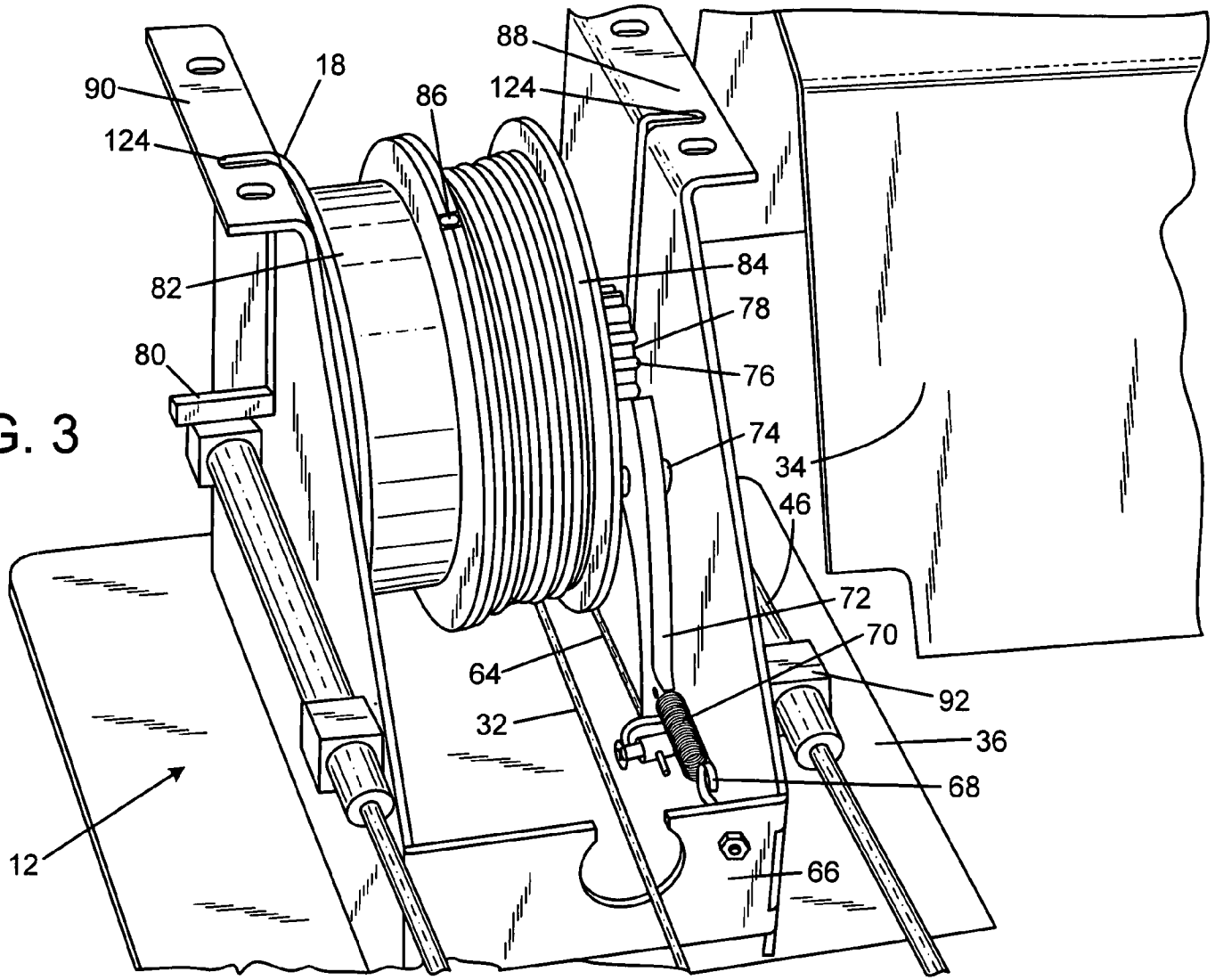
FIG. 3 is a top perspective view of the current embodiment of the drive mechanism of the present invention.

FIG. 3 illustrates the drive mechanism 12 of the improved moving target system 10 of the present invention. More particularly, the housing 34 has been removed to expose the interior of the drive mechanism 12. A left side plate 90 and a right side plate 88 rise from the base plate 36. Gas shock supports 92 attach the gas shocks 46 to the left side plate 90 and right side plate 88.

A shaft 80 passes through shaft slots 124 in the left side plate 90 and right side plate 88. A first drum 82, a second drum 84, and a gear 78 are rotatably mounted on the shaft 80. One side of the first drum 82 is attached to one side of the second drum 84 by a hook and loop fastener 86 in the current embodiment. Both drums contain a coil of flat steel that is about 1.38 inches wide and 6 inches in diameter in the current embodiment, which acts as a power spring. An example of a power spring that is suitable for use in the current invention is part number MR520D manufactured by John Evans' Sons, Inc. of Lansdale, Pa., which has 6 pounds of load and 35 feet of cable.

A power spring, commonly known as a clock spring, consists of a strip of spring-tempered material wound on an arbor and housed within a circular drum. The inner end engages the arbor and the outer end engages the restraining drum. The spring stores rotational energy by being stressed in bending when wound around the arbor. When the arbor is allowed to rotate, the spring delivers rotational energy to the arbor by expanding to the maximum curvature allowed by the drum. The torque-deflection characteristic of a power spring is nonlinear. This condition is caused by the constantly changing amount of active material, the normal hysteresis effect throughout the working deflection, and inter-coil friction.

In order to have a spring that has both adequate travel and strength, two springs are used in the current embodiment. When loaded, the two springs enable the drive mechanism 12 to pull the trolley 22 and target 26 about 21 feet in between 1.48 and 1.52 seconds. The second drum 84 has one end of the cable 32 attached to it, and the opposing end of the cable 32 passes through a cable guide plate 66 and extends out of the housing 34.

The springs are loaded as the cable 32 is uncoiled from the second drum 84. The spring is preloaded with six drum revolutions in the current embodiment. However, a preload of fewer drum revolutions can be used to achieve lower speeds and longer travel times by the trolley 22. A brake or other speed reduction mechanism can also be incorporated into the trolley 22 to slow it down. A pawl 72, which is pivotably mounted on a pawl pivot 74 attached to the right side plate 88, engages with the teeth 76 of the gear 78. A pawl spring 70, which is connected to an eye bolt 68 protruding from the cable guide plate 66, biases the pawl 72 to engage with the teeth 76. When the pawl 72 is engaged with the teeth 76 of the gear 78, it permits the cable 32 to be unwound from the second drum 84 by rotating the second drum 84 clockwise on the shaft 80, but does not permit the springs to rotate the drums counterclockwise to take up the cable 32. Unwinding the cable 32 loads the springs by coiling them into a tighter diameter.

A power takeoff cable 64 emerges from the power takeoff cable sheath 18 and is connected to the pawl 72 adjacent to the pawl spring 70. When the power takeoff cable 64 is pulled sufficiently to overcome the pawl spring 70, the pawl 72 disengages from the teeth 76 of the gear 78, freeing the loaded springs to uncoil to a larger diameter and rotate the drums counterclockwise on the shaft 80 to take up the cable 32. As the cable 32 is taken up, it pulls the trolley 22 and target 26 towards the drive mechanism 12.

Figure 4:
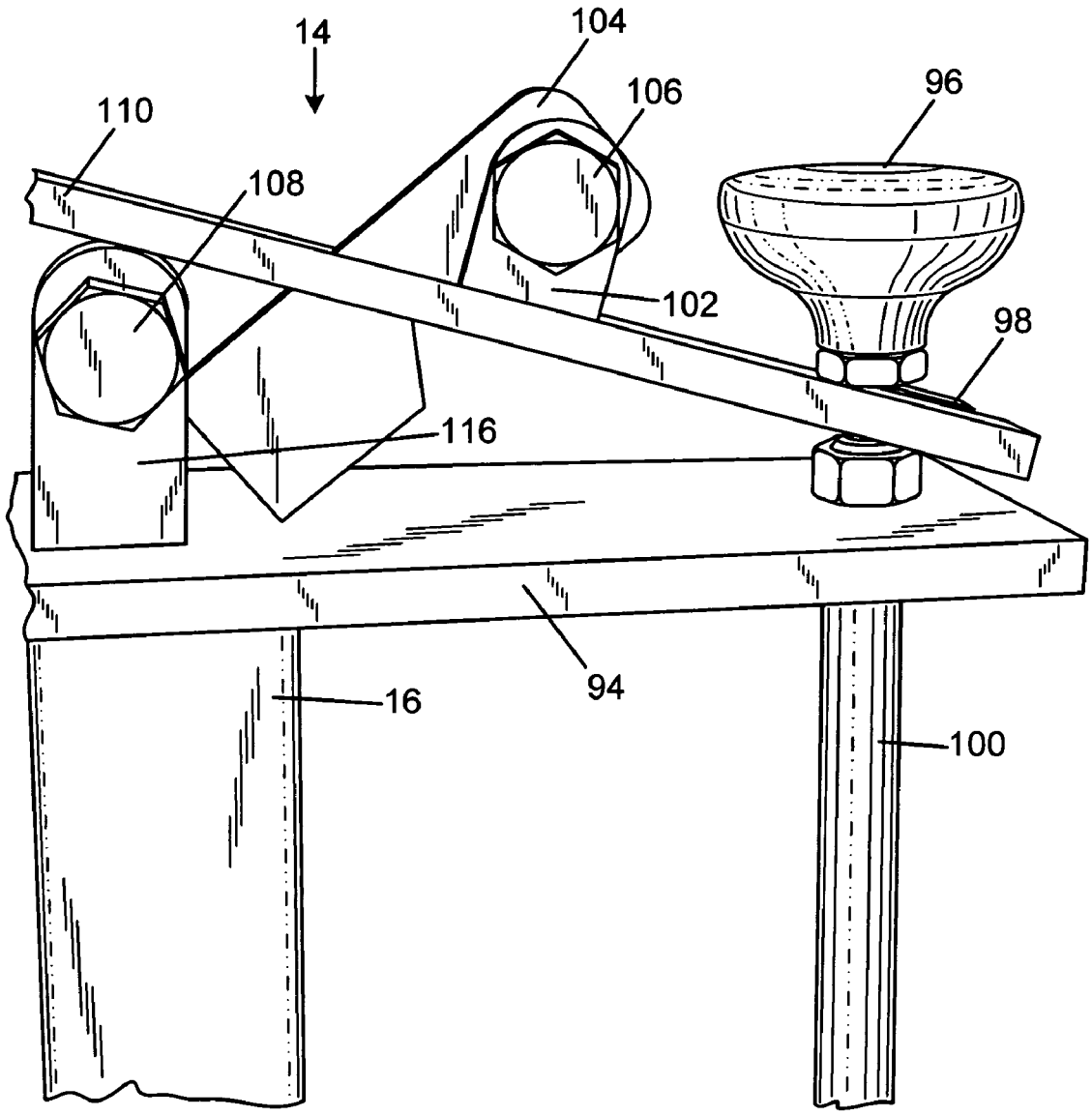
FIG. 4 is a right side view of the actuator of the present invention.

FIG. 4 illustrates the actuator 14 of the improved moving target system 10 of the present invention. More particularly, the actuator 14 is depicted in the spring loading position. The actuator 14 has a power takeoff rod 100 connected to the opposite end of the power takeoff cable 64 from the pawl 72. The pawl spring 70 biases the pawl 72 and the power take off cable 64 towards the cable guide plate 66. The power takeoff cable 64 in turn biases the power takeoff rod 100 and attached actuator knob 96 towards the actuator base 94. The actuator lever 110 pivots about the lever pivot 108 so that the knob slot 98 is positioned adjacent to the actuator base 94. An actuator stop 140 is pivoted about a stop pivot 106 to permit the actuator lever 110 to pivot about the lever pivot 108. Two base ears 116 attach the lever pivot 108 to the actuator base 94, and two lever ears 102 connect the stop pivot 106 to the actuator lever 110. The actuator lever 110 is pivotably mounted on the lever pivot 108 by a lever tube 112.

Figure 5:
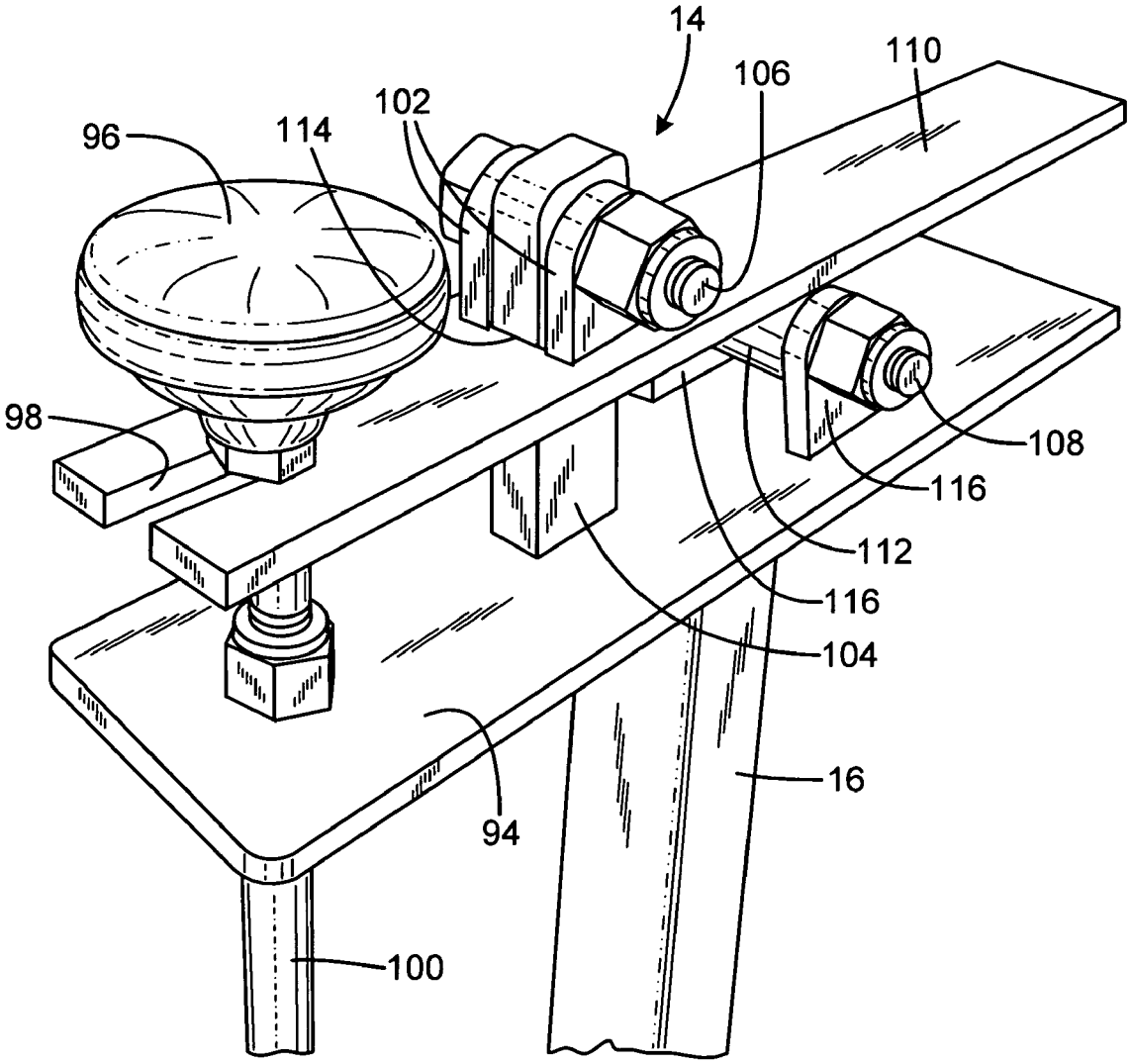
FIG. 5 is a left side perspective view of the actuator of the present invention.

FIG. 5 illustrates the actuator 14 of the improved moving target system 10 of the present invention. More particularly, the actuator 14 is depicted in the spring unloading position. The actuator lever 110 has been depressed on one end to raise the knob slot 98 away from the actuator base 94. This action raises the actuator knob 96 and pulls the power takeoff rod 100 away from the cable guide plate 66. The resulting force applied to the power takeoff cable 64 overcomes the pawl spring 70 and pivots the pawl 72 about the pawl pivot 74. This action disengages the pawl 72 from the teeth 76 of the gear 78. The actuator stop 104 pivots into a vertical position about the stop pivot 106. This prevents the pawl spring 70 from re-engaging the pawl 72 with the teeth 76 of the gear 78, even when no force is applied to the actuator lever 110, which permits the gear 78 and drums to freely rotate. Once the trolley 22 has stopped its forward motion, the instructor 30 can pivot the actuator stop 104 out of the way so the pawl spring 70 can reengage the pawl 72 with the teeth 76 of the gear 78 by pulling the power takeoff cable 64 towards the cable guide plate 66.

Figure 6:
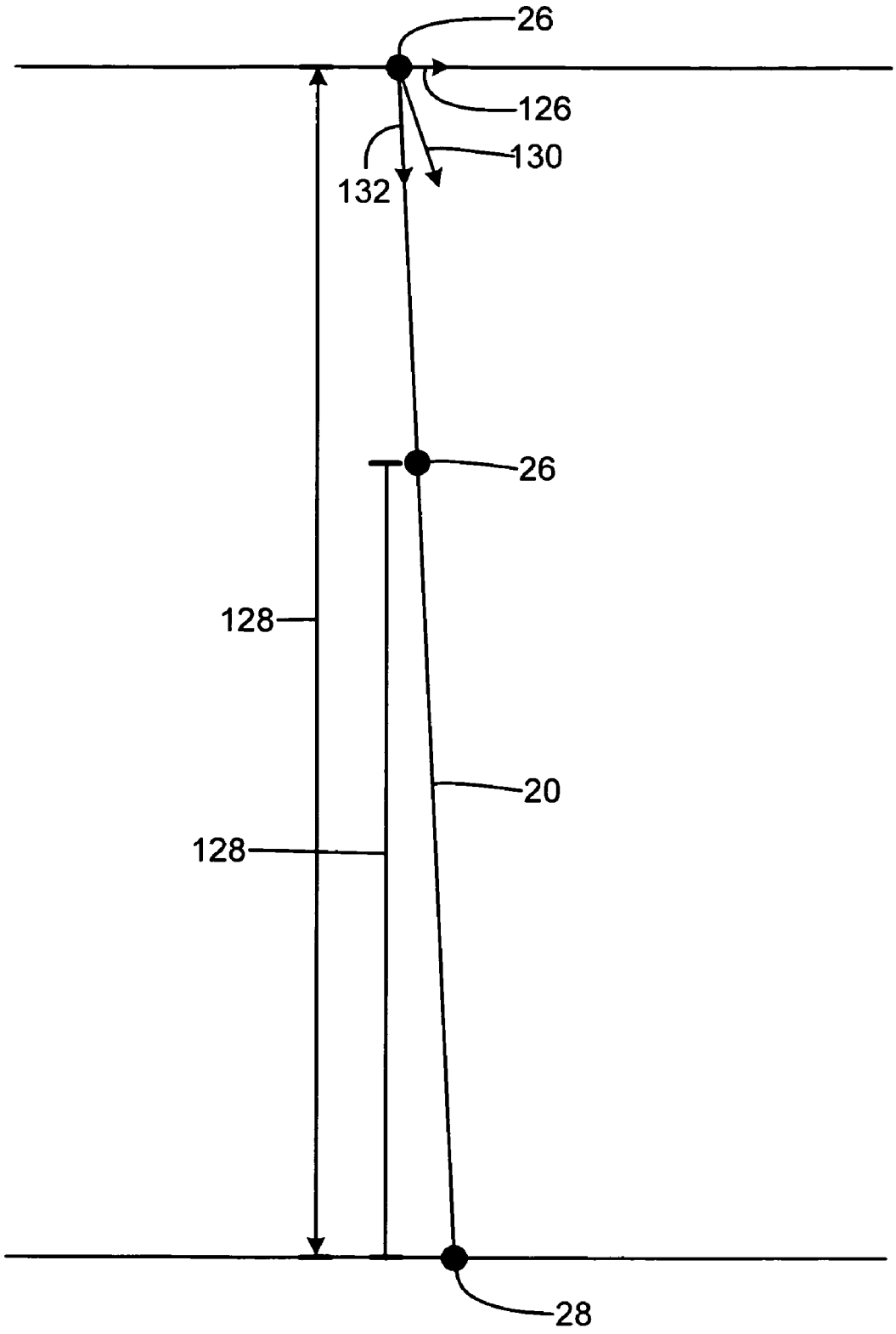
FIG. 6 is a vector diagram of the present invention

FIG. 6 is a vector diagram illustrating the velocity vectors of the trolley 22 of the present invention. More particularly, at time 1, the target 26 has a velocity vector 130 that can be decomposed into two components: a velocity vector parallel to the shooter 126 and a velocity vector perpendicular to the shooter 132. If the track 20 is positioned perpendicular to the shooter 28, then the velocity vector parallel to the shooter 126 has a magnitude of zero. Because the velocity vector perpendicular to the shooter 132 has a nonzero magnitude, the perpendicular distance 128 between the target 26 at time 1 and the shooter 28 and the perpendicular distance 120 between the target 26 at a later time 2 and the shooter 28 changes. Although the perpendicular distance 120 is depicted as decreasing in FIG. 6, the target 26, track 20, and shooter 28 can also be positioned so the perpendicular distance 120 increases with time.

While current embodiments of the moving target system for defensive training have been described in detail, it should be apparent that modifications and variations thereto are possible, all of which fall within the true spirit and scope of the invention. For example, the shooter may operate the actuator instead of an instructor. Also, the face of the target may be mounted parallel to the track in optional target holder tubes, creating a more conventional moving target that runs left to right, or right to left, instead of towards or away from the shooter. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A moving target system comprising:

an elongated ground-based track defining a track axis;

a trolley operable to move along the track;

the trolley having a target support facility;

a driver operable to move the trolley along the track;

the target support facility adapted to support a target facing in a direction angularly offset from perpendicular to the track axis;

wherein the target support facility is pivotally connected to the trolley;

wherein the target support facility pivots about a horizontal axis;

wherein the horizontal pivot axis of the target support facility is perpendicular to the track axis; and wherein the target support facility is operable to fall from a vertical position responsive to the trolley reaching an end of the track.

2. The moving target system of claim 1, wherein the target is facing in a direction angularly offset from perpendicular to the track axis by about 90 degrees, such that the target faces the direction of travel of the trolley.

3. The moving target system of claim 1, further comprising an actuator operably connected to the driver to initiate movement of the trolley when actuated.

4. The moving target system of claim 3, further comprising:

wherein the driver is positioned at one end of the track; and wherein the actuator is proximate to the driver.

5. The moving target system of claim 1, further comprising:

wherein the driver is positioned at one end of the track; and wherein the target faces the driver.

6. A moving target system comprising:

an elongated track defining a track axis;

a trolley operable to move along the track;

the trolley having a target support facility;

a driver operable to move the trolley along the track;

the target facing in a direction along the track axis;

the target support facility being pivotally connected to the trolley such that only a limited angle of rotation is possible between the target support facility and the trolley; and wherein the target to fall from a vertical position responsive to the trolley reaching an end of the track.

7. The moving target system of claim 6, wherein the track is ground-based.

8. The moving target system of claim 6, wherein the target support facility is operable to fall in the direction the target faces.

9. The moving target system of claim 6, wherein the target support facility pivots about a horizontal axis.

10. The moving target system of claim 9 wherein the horizontal pivot axis of the target support facility is perpendicular to the track axis.

11. The moving target system of claim 6, wherein the target support facility is operable to fall from a vertical position when the trolley reaches an end of the track.

12. A moving target system comprising:

an elongated track defining a track axis;

a trolley operable to move along the track;

the trolley having a target support facility;

wherein the target support facility is operable to fall from a vertical position responsive to the trolley reaching an end of the track;

a driver operable to move the trolley along the track; and the driver being a mechanical energy storage unit that may be operated in the absence of electrical power.

13. The moving target system of claim 12, wherein the target faces the driver.

14. The moving target system of claim 13, wherein the driver is positioned at an end of the track.

15. The moving target system of claim 12, wherein the driver includes a spring.

16. The moving target system of claim 12, wherein the driver has a wound condition and an unwound condition, and is changed from the unwound condition to the wound condition by moving the trolley from a first end of the track to a second end of the track.

17. The moving target system of claim 16, including a ratchet mechanism operable to retain the trolley in a selected position against a motive force generated by the driver.

* * * * *